US005414169A

United States Patent [19]

Takahashi et al.

[11] Patent Number: 5,414,169

[45] Date of Patent: May 9, 1995

[54] METHOD OF OBTAINING HYDROCARBON OIL FROM WASTE PLASTIC MATERIAL OR WASTE RUBBER MATERIAL AND APPARATUS FOR CARRYING OUT THE METHOD

[75] Inventors: Toshiki Takahashi, Higashihiroshima; Yoshio Tanimoto, Hiroshima; Akemi Muraoka, Kure; Tatsuto Fukushima, Hiroshima, all of Japan

[73] Assignee: Mazda Motor Corporation, Hiroshima, Japan

[21] Appl. No.: 183,825

[22] Filed: Jan. 21, 1994

[30] Foreign Application Priority Data

Jan. 22, 1993 [JP] Japan ..... 5-009236
Dec. 1, 1993 [JP] Japan ..... 5-301981

[51] Int. Cl.[6] ..... C07C 4/04; C07C 4/06

[52] U.S. Cl. ..... 585/241; 585/240; 208/73

[58] Field of Search ..... 585/240, 241; 208/67, 208/73

[56] References Cited

U.S. PATENT DOCUMENTS

| | | | |
|---|---|---|---|
| 4,214,110 | 7/1980 | Moroe et al. | 585/241 |
| 4,300,009 | 11/1981 | Haag et al. | 585/240 |
| 4,851,601 | 7/1989 | Fukuda et al. | 208/67 |
| 5,079,385 | 1/1992 | Wu | 585/241 |
| 5,099,086 | 3/1992 | Roy | 581/1 |
| 5,208,404 | 5/1993 | Lu | 585/240 |
| 5,288,934 | 2/1994 | de Broqueville | 585/240 |

FOREIGN PATENT DOCUMENTS

| | | |
|---|---|---|
| 2357630 | 3/1978 | France . |
| 63-178195 | 7/1988 | Japan . |

*Primary Examiner*—Anthony McFarlane
*Attorney, Agent, or Firm*—Fish & Richardson

[57] ABSTRACT

A method of obtaining hydrocarbon oil from waste plastic material or waste rubber material, comprising the steps of: subjecting the waste plastic material or the waste rubber material to thermal cracking so as to obtain a thermal cracking product; liquefying the thermal cracking product into a liquefied product; causing a liquid phase cracking reaction of the liquefied product under action of a catalyst on the liquefied product so as to produce a cracking product; and cooling the cracking product so as to obtain the hydrocarbon oil, and an apparatus used for carrying out the method.

4 Claims, 2 Drawing Sheets

METHOD OF OBTAINING HYDROCARBON OIL FROM WASTE PLASTIC MATERIAL OR WASTE RUBBER MATERIAL AND APPARATUS FOR CARRYING OUT THE METHOD

BACKGROUND OF THE INVENTION

The present invention relates to a method in which waste plastic material or waste rubber material is recycled so as to obtain hydrocarbon oil and an apparatus used for carrying out the method.

In present motor vehicles, a vehicle body panel, various interior parts, tires, etc. are formed by polymer such as plastic material or rubber material and ratio of plastic material or rubber material used for each motor vehicle has been raised gradually. Therefore, even if only one motor vehicle is scrapped after its service life, a considerable quantity of waste plastic material or waste rubber material is generated. Since a number of motor vehicles are scrapped every day at present, a total quantity of waste plastic material or waste rubber material is enormous.

Such waste plastic material or waste rubber material, which is produced in huge quantity only in connection with motor vehicles, is tested for various effective recycling purposes in various industrial fields including car industry. Furthermore, efforts for further promoting the recycling are being exerted. Under these circumstances, Japanese Patent Laid-Open Publication No. 63-178195 (1988) proposes, as one example of recycling of waste plastic material or waste rubber material, that hydrocarbon oil is produced from waste plastic material or waste rubber material and the produced hydrocarbon oil is used as fuel, etc.

In a known method of producing hydrocarbon oil from waste plastic material, the waste plastic material is subjected to thermal cracking so as to obtain thermal cracking gas and the thermal cracking gas is subjected to vapor phase catalytic cracking by using proper catalyst so as to obtain catalytic cracking gas and then, the catalytic cracking gas is cooled so as to obtain hydrocarbon oil having relatively low boiling point. For example, in a method disclosed in the above mentioned prior art document No. 63-178195 (1988), thermal cracking of the plastic material is performed in melt phase at a temperature of 390° C. to 500° C., while vapor phase catalytic cracking of the thermal cracking gas is performed at a temperature of 200° C. to 350° C. by using zeolite as the catalyst. As a result, low-boiling hydrocarbon oil containing 22 carbon atoms or less is obtained. This known method in which the hydrocarbon oil is obtained by thermal cracking, vapor phase catalytic cracking and cooling steps can be applied to not only waste plastic material but waste rubber material.

Meanwhile, in case thermal cracking of waste plastic material is performed at relatively high temperature, ratio of gaseous component increases and thus, recovery of desired low-boiling hydrocarbon oil drops. A countermeasure for eliminating this drawback is proposed in, for example, Japanese Patent Laid-Open Publication No. 52-144088 (1977) in which in order to set thermal cracking temperature relatively low, thermal cracking of the waste plastic material is performed in a state where mixture of the waste plastic material and aluminum chloride acting as catalyst is being stirred.

When the hydrocarbon oil is produced from waste plastic material or waste rubber material as described above, catalyst such as zeolite used for vapor phase catalytic cracking of the thermal cracking gas produced through thermal cracking of the waste plastic material or the waste rubber material is maintained at not more than a predetermined temperature lower than a temperature for thermal cracking of the waste plastic material or the waste rubber material so as to prevent a phenomenon in which heat deterioration of the catalyst leads to, for example, production of a large quantity of hydrocarbon gas. Therefore, the thermal cracking gas produced through thermal cracking of the waste plastic material or the waste rubber material is cooled by the catalyst during vapor phase catalytic cracking. Consequently, such a problem arises that heavy component (wax component) contained in the thermal cracking gas adheres to the catalyst, thereby resulting in drop of function of the catalyst. Meanwhile, the heavy component contained in the thermal cracking gas subjected to vapor phase catalytic cracking is mixed into the hydrocarbon oil obtained by vapor phase catalytic cracking, thereby undesirably resulting in deterioration of quality and drop of recovery of the finally recovered hydrocarbon oil.

Furthermore, when in order to set thermal cracking temperature relatively low, thermal cracking of the waste plastic material is performed in a state where mixture of the waste plastic material and aluminum chloride acting as catalyst is being stirred as described above, molten substance obtained by thermal cracking has relatively high viscosity and thus, such disadvantages are incurred that efficiency for stirring the mixture is not so high and the catalyst evaporates rapidly.

SUMMARY OF THE INVENTION

Accordingly, an essential object of the present invention is to provide a method of obtaining hydrocarbon oil from waste plastic material or waster rubber material and an apparatus used for carrying out the method, with a view to eliminating the above mentioned disadvantages inherent in prior art that when the hydrocarbon oil is produced based on thermal cracking gas obtained by thermal cracking of the waste plastic material or the waste rubber material, function of catalyst used for vapor phase catalytic cracking of the thermal cracking gas drops and that when thermal cracking of the waste plastic material is performed at relatively low temperature in a state where mixture of the waste plastic material and catalyst is being stirred, efficiency for stirring the mixture is not so high and the catalyst evaporates rapidly, in which content of heavy component of the finally recovered hydrocarbon oil is reduced and yield of the hydrocarbon oil is raised as compared with a case where the thermal cracking gas is subjected to vapor phase catalytic cracking by using zeolite or the like as the catalyst.

In order to accomplish this object of the present invention, a method of obtaining hydrocarbon oil from waste plastic material or waste rubber material, according to the present invention comprises the steps of: subjecting the waste plastic material or the waste rubber material to thermal cracking so as to obtain a thermal cracking product; liquefying the thermal cracking product into a liquefied product; causing a liquid phase cracking reaction of the liquefied product under action of a catalyst on the liquefied product so as to produce a cracking product; and cooling the cracking product so as to obtain the hydrocarbon oil.

In the method, it is preferable that the catalyst used for the liquefied product is acid catalyst.

Meanwhile, an apparatus for producing hydrocarbon oil, according to the present invention comprises: a thermal cracking portion in which waste plastic material or waste rubber material is subjected to thermal cracking at a predetermined temperature so as to obtain a thermal cracking product; a liquefaction portion in which the thermal cracking product is liquefied so as to obtain a liquefied product; a liquid phase cracking portion in which a liquid phase cracking reaction of the liquefied product is caused under action of a catalyst on the liquefied product so as to obtain a cracking product of the liquefied product; and an oil recovery portion in which the hydrocarbon oil is produced from the cracking product.

In the apparatus, it is preferable that acid catalyst is used as the catalyst for the liquefied product in the liquid phase cracking portion.

As described above, in the method of obtaining the hydrocarbon oil from the waste plastic material or the waste rubber material, according to the present invention and the hydrocarbon oil producing apparatus of the present invention, the waste plastic material or the waste rubber material is subjected to thermal cracking so as to obtain the thermal cracking product. Subsequently, without being subjected to vapor phase catalytic cracking employing catalyst, the thermal cracking product is liquefied and then, the liquid phase cracking reaction of the liquefied product is caused by using the catalyst such as acid catalyst so as to produce the cracking product such that the hydrocarbon oil is obtained from the cracking product.

Therefore, in accordance with the present invention, such problems are eliminated that when catalyst is used for vapor phase catalytic cracking of thermal cracking gas obtained, as thermal cracking product, by thermal cracking of waste plastic material or waste rubber material, heavy component contained in the thermal cracking gas adheres to the catalyst so as to deteriorate function of the catalyst and that when thermal cracking of the waste plastic material is performed at relatively low temperature in a state where mixture of the waste plastic material and catalyst is being stirred, efficiency for stirring the mixture is not so high and the catalyst evaporates rapidly.

Furthermore, in accordance with the present invention, since content of heavy component of the finally recovered hydrocarbon oil is reduced and yield of the hydrocarbon oil is raised as compared with a case where the thermal cracking gas is subjected to vapor phase catalytic cracking by using zeolite or the like as the catalyst, quality and recovery of the hydrocarbon oil are improved.

BRIEF DESCRIPTION OF THE DRAWINGS

This object and features of the present invention will become apparent from the following description taken in conjunction with the preferred embodiment thereof with reference to the accompanying drawings, in which.

DETAILED DESCRIPTION OF THE INVENTION

Figure 1:
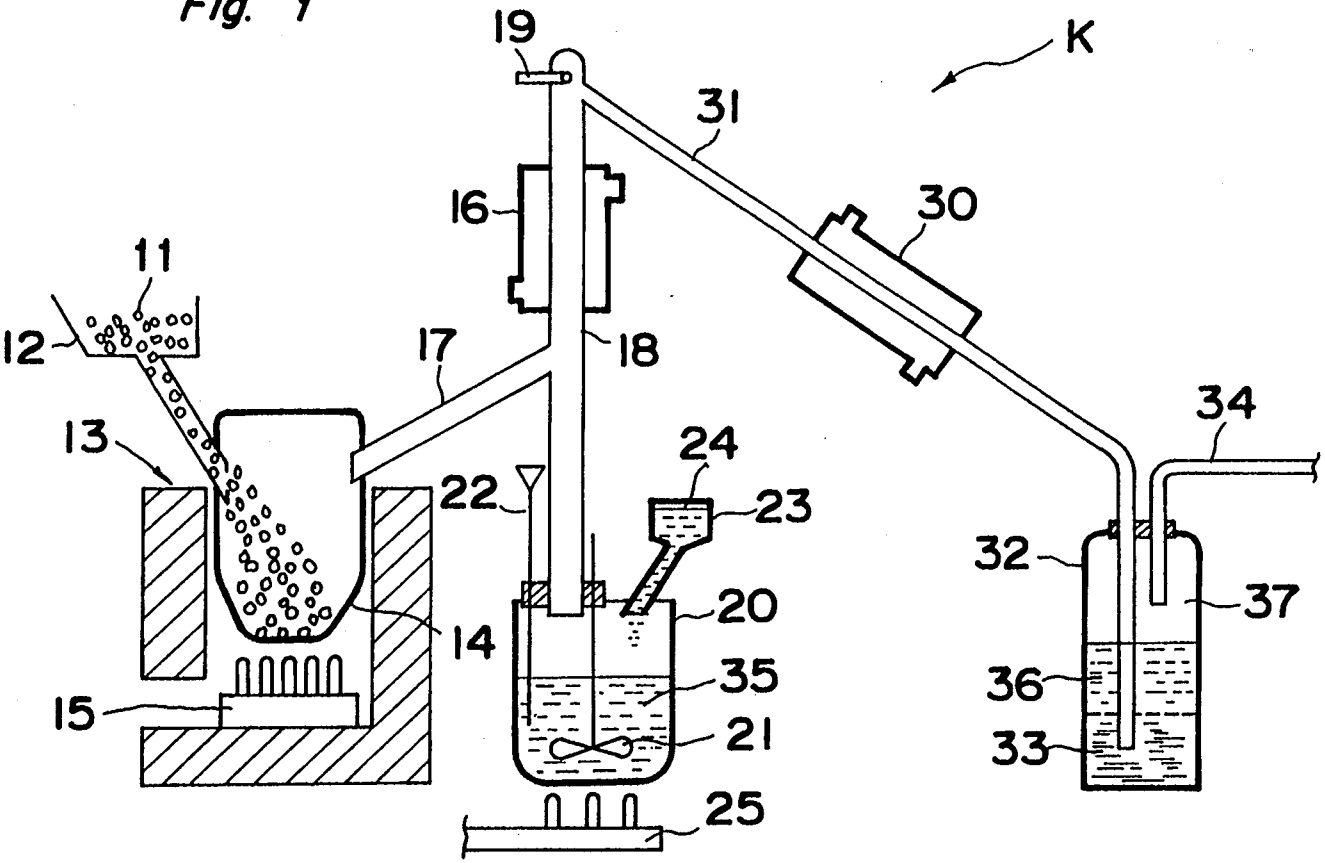
FIG. 1 is a schematic view of a hydrocarbon oil producing apparatus of the present invention, which is used for carrying out a method of obtaining hydrocarbon oil from waste plastic material or waste rubber material, according to the present invention.

Referring now to the drawings, there is shown in FIG. 1, a hydrocarbon oil producing apparatus K of the present invention, which is used for carrying out a method of obtaining hydrocarbon oil from waste plastic material or waste rubber material, according to the present invention. In FIG. 1, the apparatus K includes a hopper 12 having a feeder, in which recycling material 11 such as waste plastic material including ground high-density polyethylene (HDPE) or waste rubber material is stored. A thermal cracking tank 13 for performing thermal cracking of the recycling material 11 is provided in operative association with the hopper 12. The thermal cracking tank 13 includes a tank body 14 to which the recycling material 11 is supplied from the hopper 12 through the feeder and a heater 15 for heating the tank body 14 so as to perform thermal cracking of the recycling material 11 supplied into the tank body 14. The heater 15 is provided outside the tank body 14. A temperature sensor (not shown) for detecting temperature of interior of the tank body 14 is provided on the tank body 14. Temperature control of the heater 15 is performed on the basis of detection output of this temperature sensor such that thermal cracking temperature in the tank body 14 ranges from 450° C. to 550° C.

Thermal cracking gas is obtained as thermal cracking product in the tank body 14. An upper portion of the tank body 14 of the thermal cracking tank 13 is coupled with one end of a duct 17 for guiding the thermal cracking gas to a liquefaction portion 16. The other end of the duct 17 is coupled with a duct 18 provided with the liquefaction portion 16. A temperature sensor 19 for detecting temperature of light component gas flowing upwardly out of the liquefaction portion 16 is provided at an upper end of the duct 18 so as to be disposed above the liquefaction portion 16.

A lower end of the duct 18 is coupled with a catalytic reaction tank 20. The catalytic reaction tank 20 is provided with a rotary stirrer 21, a liquid quantity sensor 22 and a catalyst feeder 23. The catalyst feeder 23 stores acid catalyst 24 such as synthetic zeolite used as builder for synthetic detergent, etc. and sulfuric acid so as to supply the acid catalyst 24 into the catalytic reaction tank 20. A temperature sensor (not shown) for detecting temperature of interior of the catalytic reaction tank 20 is provided on the catalytic reaction tank 20. Temperature control of a heater 25 for heating the catalytic reaction tank 20 is performed on the basis of detection output of this temperature sensor such that temperature in the catalytic reaction tank 20 ranges from 200° C. to 350° C.

One end of a duct 31 provided with a cooler 30 is coupled with the upper end of the duct 18, at which the temperature sensor 19 is disposed. The other end of the duct 31 extends into a neutralization and oil separation tank 32. The neutralization and oil separation tank 32 stores 20% sodium hydroxide aqueous solution 33 acting as neutralization liquid and the other end of the duct 31 is dipped into the 20% sodium hydroxide aqueous solution 33. An upper portion of the neutralization and oil separation tank 32 is communicated with exterior through a duct 34.

Hereinbelow, one example of the method of obtaining hydrocarbon oil from waste plastic material or waste rubber material by using the hydrocarbon oil producing apparatus K of the above described arrangement, according to the present invention is described. Initially, the recycling material 11 stored in the hopper 12 is supplied into the tank body 14 of the thermal cracking tank 13 by the feeder provided on the hopper 12. Then, the tank body 14 is heated by the heater 15 of the thermal cracking tank 13 such that thermal cracking of the recycling material 11 is performed in the tank body 14. At this time, temperature control of the heater 15 is performed such that thermal cracking temperature in the tank body 14 ranges from 450° C. to 550° C. As a result, thermal cracking gas which is thermal cracking product obtained by thermal cracking of the recycling material 11 is obtained in the tank body 14.

The thermal cracking gas obtained in the tank body 14 is drawn, through the duct 17 and a portion of the duct 18, into the liquefaction portion 16. In the liquefaction portion 16, heavy component in the thermal cracking gas is liquefied. Then, the heavy component liquefied by the liquefaction portion 16 is carried, as liquefied product 35, into the catalytic reaction tank 20 via the duct 18.

When the liquid quantity sensor 22 detects that the liquefied product 35 in the catalytic reaction tank 20 has reached a predetermined quantity, a detection output signal is delivered by the liquid quantity sensor 22. In response to this detection output signal from the liquid quantity sensor 22, a proper quantity of the acid catalyst 24 is supplied from the catalyst feeder 23 into the catalytic reaction tank 20. Furthermore, in response to the detection output signal from the liquid quantity sensor 22, not only the rotary stirrer 21 is actuated but the catalytic reaction tank 20 is heated by the heater 25 such that temperature in the catalytic reaction tank 20 ranges from 200° C. to 350° C.

In the catalytic reaction tank 20, the liquefied product 35 to which the acid catalyst 24 is added causes a liquid phase cracking reaction under action of the acid catalyst 24 while being stirred by the rotary stirrer 21 and being heated to a temperature of 200° C. to 350° C. Thus, in the catalytic reaction tank 20, catalytic reaction cracking gas is obtained as cracking product. The catalytic reaction cracking gas obtained in the catalytic reaction tank 20 is drawn to the liquefaction portion 16 through the duct 18. Thus, heavy component contained in the catalytic reaction cracking gas from the catalytic reaction tank 20 is liquefied in the liquefaction portion 16 so as to be again returned to the catalytic reaction tank 20 by way of the duct 18.

Thus, light component gas contained in the catalytic reaction cracking gas obtained in the catalytic reaction tank 20 passes through the liquefaction portion 16 via the duct 18 and flows to the upper end of the duct 18, which is disposed above the liquefaction portion 16. At this time, temperature control in the liquefaction portion 16 is performed on the basis of detection output from the temperature sensor 19 such that the light component gas flowing from the liquefaction portion 16 to the upper end of the duct 18 ranges from 200° C. to 250° C. Thereafter, the light component gas flowing from the liquefaction portion 16 to the upper end of the duct 18 is fed from the upper end of the duct 18 to the cooler 30 through the duct 31. Thus, the light component gas is liquefied into low-boiling hydrocarbon oil by the cooler 30 and the low-boiling hydrocarbon oil is supplied, via a portion of the duct 31 downstream of the cooler 30, into the 20% sodium hydroxide aqueous solution 33 stored, as neutralization liquid, in the neutralization and oil separation tank 32.

Therefore, in the neutralization and oil separation tank 22, first and second low-boiling hydrocarbon oils are, respectively, obtained by cooling by the cooler 30 light component gas contained in the thermal cracking gas from interior of the tank body 14 and light component gas contained in the catalytic reaction cracking gas obtained in the catalytic reaction tank 20. Hydrochloric acid mixed into the first and second low-boiling hydrocarbon oils is neutralized by the 20% sodium hydroxide aqueous solution 33 acting as neutralization liquid. Thus, in the neutralization and oil separation tank 32, a layer of the 20% sodium chloride aqueous solution 33, a layer of low-boiling hydrocarbon oil 36 and a layer of gas component 37 are formed sequentially upwardly in this order from a bottom of the neutralization and oil separation tank 32. Namely, in the neutralization and oil separation tank 32, the low-boiling hydrocarbon oil 36 produced by thermal cracking of the recycling material 11 is recovered. Meanwhile, the gas component 37 obtained in the neutralization and oil separation tank 32 is recovered through the duct 34 so as to be utilized at, for example, the heaters 15 and 25.

As described above, when the low-boiling hydrocarbon oil 37 is recovered from the thermal cracking gas obtained by thermal cracking of the recycling material 11, the thermal cracking gas obtained by thermal cracking of the recycling material 11 is not subjected to vapor phase catalytic cracking employing catalyst but is liquefied into the liquefied product 35 in the liquefaction portion 16. Then, in the catalytic reaction tank 20, the liquefied product 35 causes a liquid phase cracking reaction by using, for example, synthetic zeolite as the acid catalyst so as to produce the catalytic reaction cracking gas such that the low-boiling hydrocarbon oil 36 is obtained by cooling the catalytic reaction cracking gas.

Therefore, in accordance with the present invention, such problems are eliminated that when catalyst is used for vapor phase catalytic cracking of the thermal cracking gas obtained by thermal cracking of the waste plastic material, heavy component contained in the thermal cracking gas adheres to the catalyst so as to deteriorate function of the catalyst and that when thermal cracking of the waste plastic material is performed at relatively low temperature in a state where mixture of the waste plastic material and catalyst is being stirred, efficiency for stirring the mixture is not so high and the catalyst evaporates rapidly.

Furthermore, in accordance with the present invention, content of heavy component of the low-boiling hydrocarbon oil 36 recovered in the neutralization and oil separation tank 32 is low and yield of the low-boiling hydrocarbon oil 36 is raised as compared with a case where the thermal cracking gas is subjected to vapor phase catalytic cracking by using zeolite or the like as the catalyst.

Figure 2:
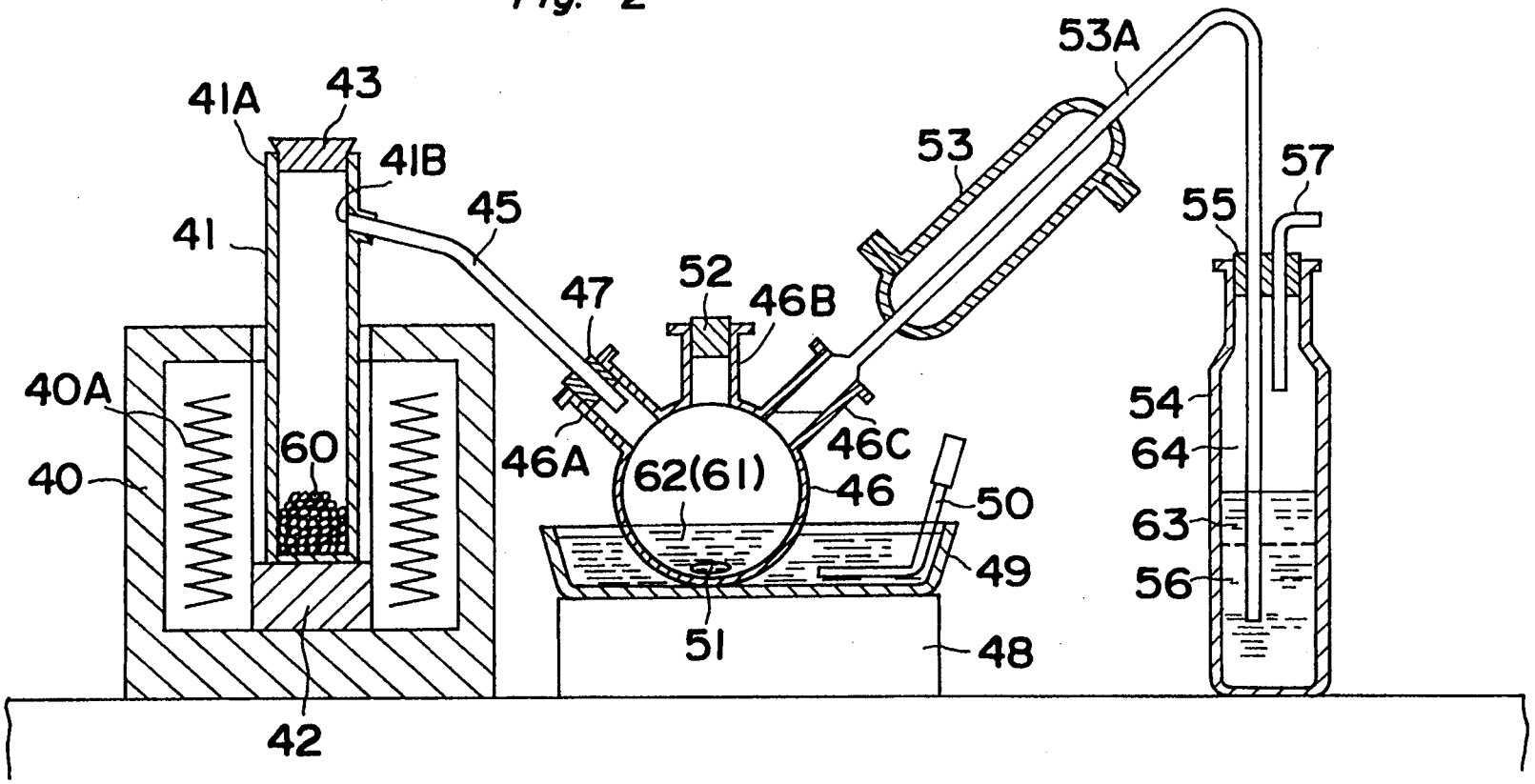
FIG. 2 is a schematic view of an experimental apparatus employed for comparison between the method of the present invention and another method.

By using an experimental apparatus shown in FIG. 2, experiments were conducted by the present inventors for comparison between recovery of hydrocarbon oil obtained from waste plastic material in the method of the present invention and that obtained from waste plastic material in another method other than the method of the present invention. In FIG. 2, the experimental apparatus includes an annular oven 40 in which a closed-end thermal cracking tube 41 made of stainless steel is placed on a heat insulator 42 so as to be surrounded by an annular heater 40A. A mouth 41A disposed at an upper end of the closed-end thermal cracking tube 41 is closed by a plug 43. One end of a duct 45 is coupled with a through-hole 41B formed at an upper portion of the closed-end thermal cracking tube 41.

A flask 46 has projecting mouths 46A, 46B and 46C. A plug 47 is provided at the projecting mouth 46A of the flask 46, while the projecting mouth 46B of the flask 46 is closed by a plug 52. The other end of the duct 45 pierces through the plug 47 into the projecting mouth 46A. The flask 46 is provided in an oil tank 49 placed on a magnetic stirring machine 48 and a heater 50 is provided in the oil tank 49. A stirrer 51 which is remotely driven by the magnetic stirring machine 50 is provided in the flask 46. One end of a duct 53A of a cooler 53 is coupled with the projecting mouth 46C of the flask 46. A plug 55 is provided at a mouth of a neutralization and oil separation bottle 54. The other end of the duct 53A of the cooler 53 pierces through the plug 55 of the neutralization and oil separation bottle 54 into the neutralization and oil separation tank 54. Meanwhile, 20% sodium hydroxide aqueous solution 56 acting as neutralization liquid is stored in the neutralization and oil separation tank 54 such that the other end of the duct 53A of the cooler 53 reaches the 20% sodium hydroxide aqueous solution 56. Furthermore, interior of the neutralization and oil separation bottle 54 is communicated with exterior via a duct 57 piercing through the plug 55.

In a first experiment employing such experimental apparatus, hydrocarbon oil is produced from waste plastic material in the method of the present invention. Initially, 5 g of high-density polyethylene 60 is put, as waste plastic material, into the closed-end thermal cracking tube 41 from the mouth 41A. Subsequently, the mouth 41A of the closed-end thermal cracking tube 41 is closed by the plug 43. Meanwhile, 1 g of synthetic zeolite used as builder for synthetic detergent is poured, as catalyst 61, into the flask 46 from the projecting mouth 46B. Then, the projecting mouth 46B of the flask 46 is closed by the plug 52. Thereafter, the flask 46 is heated by the heater 50 provided in the oil tank 49 such that interior of the flask 46 is maintained at a temperature of about 200° C. While the stirrer 51 in the flask 46 is being remotely driven by the magnetic stirring machine 48, the annular oven 40 is heated by the annular heater 40A in the annular oven 40 such that interior of the annular oven 40 is maintained at a temperature of 450° C.

As a result, in the closed-end thermal cracking tube 41, 5 g of the high-density polyethylene 60 is subjected to thermal cracking into thermal cracking gas. When the thermal cracking gas is delivered into the flask 46 from interior of the closed-end thermal cracking tube 41 via the duct 45, the thermal cracking gas is cooled in the duct 45 and the flask 46 so as to be liquefied into liquefied product 62 such that the liquefied product 62 remains in the flask 46. Through stirring effected by the stirrer 51, the liquefied product 62 in the flask 46 is mixed with the catalyst 61 formed by 1 g of synthetic zeolite used as builder for synthetic detergent so as to cause a liquid phase cracking reaction by action of the catalyst 61. Thus, cracking gas produced by the liquid phase cracking reaction of the liquefied product 62 is obtained in the flask 46 so as to be led to the duct 53A of the cooler 53. Therefore, the cracking gas from the flask 46 is cooled into low-boiling hydrocarbon oil by the cooler 53. The low-boiling hydrocarbon oil is further collected into the neutralization and oil separation bottle 54 via the duct 53A of the cooler 53. As a result, in the neutralization and oil separation bottle 54, a layer of 20% sodium hydroxide aqueous solution 56, a layer of low-boiling hydrocarbon oil 63 and a layer of unreactive cracking gas component 64 are formed sequentially upwardly in this order from a bottom of the neutralization and oil separation bottle 54.

When the unreactive cracking gas component 64 obtained in the neutralization and oil separation bottle 54 as described above is recovered through the duct 57 and the low-boiling hydrocarbon oil 63 recovered in the neutralization and oil separation bottle 54 is discharged, production of no heavy component (wax component) is found. Meanwhile, a ratio by weight of the discharged low-boiling hydrocarbon oil 63 to the recovered unreactive cracking gas component 64 is 57:43.

On the other hand, in a second experiment employing the above experimental apparatus for comparison with the first experiment, hydrocarbon oil is produced from waste plastic material in another method other than the method of the present invention. In this method, waste plastic material is subjected to thermal cracking into thermal cracking gas and the thermal cracking gas is subjected to vapor phase catalytic cracking into catalytic cracking gas by using proper solid acid catalyst. Then, the catalytic cracking gas is cooled and neutralized so as to obtain low-boiling hydrocarbon oil. To this end, 5 g of high-density polyethylene acting as waste plastic material is prepared so as to be subjected, for 1 g of the high-density polyethylene at a time, to thermal cracking a total of five times, 3 g of zeolite is used as solid acid catalyst for vapor phase catalytic cracking and temperature is set at 250° C. As a result, unreactive cracking gas, low-boiling hydrocarbon oil and heavy component (wax component) are obtained finally and a ratio by weight of the low-boiling hydrocarbon oil to the heavy component and the unreactive cracking gas is 42:1:57.

It is found from the above mentioned results of the first and second experiments that recovery of the hydrocarbon oil produced from waste plastic material in the method of the present invention is remarkably improved in comparison with that produced from waste plastic material in another method other than the method of the present invention.

As is clear from the foregoing description of the method of obtaining the hydrocarbon oil from the waste plastic material or the waste rubber material, according to the present invention and the hydrocarbon oil producing apparatus of the present invention, the waste plastic material or the waste rubber material is subjected to thermal cracking into the thermal cracking product. Subsequently, without being subjected to vapor phase catalytic cracking employing catalyst, the thermal cracking product is liquefied and then, causes a liquid phase cracking reaction by using the acid catalyst as catalyst so as to produce the cracking product such that the hydrocarbon oil is obtained from the cracking product.

Therefore, in accordance with the invention, such problems are eliminated that when catalyst is used for vapor phase catalytic cracking of the thermal cracking gas obtained, as the thermal cracking product, by thermal cracking of the waste plastic material or the waste rubber material, heavy component contained in the thermal cracking gas adheres to the catalyst so as to deteriorate function of the catalyst and that when thermal cracking of the waste plastic material is performed at relatively low temperature in a state where mixture of the waste plastic material and catalyst is being stirred, efficiency for stirring the mixture is not so high and the catalyst evaporates rapidly.

Furthermore, in accordance with the present invention, since content of heavy component of the finally recovered hydrocarbon oil is reduced and yield of the hydrocarbon oil is raised as compared with a case where the thermal cracking gas is subjected to vapor phase catalytic cracking by using zeolite or the like as the catalyst, quality and recovery of the hydrocarbon oil are improved.

What is claimed is:

1. A method of obtaining hydrocarbon oil from waste plastic material or waste rubber material, comprising the steps of:

subjecting the waste plastic material or the waste rubber material to thermal cracking so as to obtain a thermal cracking product;

liquefying the thermal cracking product into a liquefied product;

causing a liquid phase cracking reaction of the liquefied product under action of a catalyst on the liquefied product so as to produce a cracking product; and cooling the cracking product so as to obtain the hydrocarbon oil.

2. A method as claimed in claim 1, wherein the catalyst used for the liquefied product is acid catalyst.

3. A method as claimed in claim 1, wherein thermal cracking of the waste plastic material or the waste rubber material is performed at a temperature of 450° C. to 550° C. and the liquid phase cracking reaction of the liquefied product is performed at a temperature of 200° C. to 350° C.

4. A method as claimed in claim 2, wherein thermal cracking of the waste plastic material or the waste rubber material is performed at a temperature of 450° C. to 550° C. and the liquid phase cracking reaction of the liquefied product is performed at a temperature of 200° C. to 350° C.

* * * * *